US011911876B2

(12) United States Patent
Nelson et al.

(10) Patent No.: US 11,911,876 B2
(45) Date of Patent: Feb. 27, 2024

(54) TOOLING SPLICE ACCOMMODATION FOR ABRASIVE ARTICLE PRODUCTION

(71) Applicant: 3M INNOVATIVE PROPERTIES COMPANY, St. Paul, MN (US)

(72) Inventors: Thomas J. Nelson, Woodbury, MN (US); Aaron K. Nienaber, Lake Elmo, MN (US); Joseph B. Eckel, Vadnais Heights, MN (US); Ann M. Hawkins, Lake Elmo, MN (US); Amelia W. Koenig, Minneapolis, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 506 days.

(21) Appl. No.: 17/415,039

(22) PCT Filed: Dec. 17, 2019

(86) PCT No.: PCT/IB2019/060949
§ 371 (c)(1),
(2) Date: Jun. 17, 2021

(87) PCT Pub. No.: WO2020/128853
PCT Pub. Date: Jun. 25, 2020

(65) Prior Publication Data

US 2022/0040817 A1 Feb. 10, 2022

Related U.S. Application Data

(60) Provisional application No. 62/780,998, filed on Dec. 18, 2018.

(51) Int. Cl.
*B24D 11/00* (2006.01)
*B24D 3/28* (2006.01)
(Continued)

(52) U.S. Cl.
CPC ..... *B24D 11/005* (2013.01); *B24D 3/28* (2013.01); *B24D 11/06* (2013.01); *B24D 18/0072* (2013.01)

(58) Field of Classification Search
CPC ..... B24D 11/00; B24D 11/005; B24D 3/28; B24D 11/06; B24D 18/0072
(Continued)

(56) References Cited

U.S. PATENT DOCUMENTS 1,910,444 A 5/1933 Nicholson
2,141,658 A 12/1938 Melton
(Continued)

FOREIGN PATENT DOCUMENTS

EP 1207015 5/2002
EP 3086903 7/2015
(Continued)

OTHER PUBLICATIONS

International Search Report for PCT International Application No. PCT/IB2019/060613, dated Feb. 21, 2020, 4 pages.
(Continued)

*Primary Examiner* — James E McDonough
(74) *Attorney, Agent, or Firm* — Aleksander Medved

(57) ABSTRACT

A system and method for producing an abrasive article includes a production tool configured to provide shaped abrasive particles to a resin coated backing. A first end and a second end of the production tool are spliced together to form a spliced area. The production tool includes a dispensing surface that includes a plurality of cavities formed between the first end and the second end and configured to receive and hold the shaped abrasive particles. The resin coated backing is configured to receive the shaped abrasive particles from the dispensing surface of the production tool and configured to receive further shaped abrasive particles to
(Continued)

fill gaps in the shaped abrasive particles caused by an absence of the plurality of cavities in the spliced area.

16 Claims, 9 Drawing Sheets

(51) Int. Cl.
*B24D 11/06* (2006.01)
*B24D 18/00* (2006.01)

(58) Field of Classification Search
USPC ..... 51/293, 298, 307, 309
See application file for complete search history.

(56) References Cited

U.S. PATENT DOCUMENTS 3,041,156 A 6/1962 Rowse
3,058,819 A 10/1962 Paulson
3,616,580 A 11/1971 Dewell
3,676,092 A 7/1972 Buell
3,729,873 A * 5/1973 Sandell ..... B24D 11/06 51/297
3,784,365 A 1/1974 Caserta
3,833,346 A 9/1974 Wirth
3,868,232 A 2/1975 Sioui
3,869,834 A 3/1975 Mullin
4,215,516 A * 8/1980 Huschle ..... F16G 3/10 156/304.3
4,314,827 A 2/1982 Leitheiser
4,475,926 A 10/1984 Hickory
4,623,364 A 11/1986 Cottringer
4,652,275 A 3/1987 Bloecher
4,734,104 A 3/1988 Broberg
4,737,163 A 4/1988 Larkey
4,744,802 A 5/1988 Schwabel
4,751,138 A 6/1988 Tumey
4,770,671 A 9/1988 Monroe
4,799,939 A 1/1989 Bloecher
4,881,951 A 11/1989 Wood
4,997,461 A 3/1991 Markhoff-Matheny
5,009,675 A 4/1991 Kunz
5,011,508 A 4/1991 Wald
5,042,991 A 8/1991 Kunz
5,078,753 A 1/1992 Broberg
5,085,671 A 2/1992 Martin
5,152,917 A 10/1992 Pieper
5,201,916 A 4/1993 Berg
5,203,884 A 4/1993 Buchanan
5,213,591 A 5/1993 Celikkaya
5,269,821 A 12/1993 Helmin
5,352,254 A 10/1994 Celikkaya
5,366,523 A 11/1994 Rowenhorst
5,378,251 A 1/1995 Culler
5,417,726 A 5/1995 Stout
5,435,816 A 7/1995 Spurgeon
5,436,063 A 7/1995 Follett
5,453,106 A 9/1995 Roberts
5,496,386 A 3/1996 Broberg
5,498,268 A 3/1996 Gagliardi
5,520,711 A 5/1996 Helmin
5,609,706 A 3/1997 Benedict
RE35,570 E 7/1997 Rowenhorst
5,672,097 A 9/1997 Hoopman
5,766,277 A 6/1998 DeVoe
5,946,991 A 9/1999 Hoopman
5,954,844 A 9/1999 Law
5,961,674 A 10/1999 Gagliardi
5,975,987 A 11/1999 Hoopman
5,975,988 A 11/1999 Christianson
5,984,988 A 11/1999 Berg
6,077,601 A 6/2000 DeVoe
6,129,540 A 10/2000 Hoopman
6,228,133 B1 5/2001 Thurber
7,553,346 B2 6/2009 Welygan
8,034,137 B2 10/2011 Erickson
8,080,072 B2 12/2011 Woo
8,142,531 B2 3/2012 Adefris
8,142,532 B2 3/2012 Erickson
8,142,891 B2 3/2012 Culler
9,017,150 B2 4/2015 Keipert
9,440,332 B2 9/2016 Gaeta
9,457,453 B2 10/2016 Seth
9,604,346 B2 3/2017 Breder
9,776,302 B2 10/2017 Keipert
9,969,057 B2 5/2018 Eugster
2001/0003884 A1 6/2001 Wei
2009/0165394 A1 7/2009 Culler
2009/0169816 A1 7/2009 Erickson
2012/0227333 A1 9/2012 Adefris
2013/0040537 A1 2/2013 Schwabel
2013/0125477 A1 5/2013 Adefris
2013/0344786 A1 12/2013 Keipert
2014/0106126 A1 4/2014 Gaeta
2014/0290147 A1 10/2014 Seth
2015/0224629 A1 8/2015 Moren
2015/0291866 A1 10/2015 Arcona
2016/0311081 A1 10/2016 Culler
2016/0311084 A1* 10/2016 Culler ..... B24D 18/0054
2016/0315081 A1 10/2016 Park
2017/0050293 A1 2/2017 Gaeta
2017/0225299 A1 8/2017 Keipert
2017/0368667 A1 12/2017 Keipert
2018/0029194 A1 2/2018 Keipert
2018/0086957 A1 3/2018 Sahlin

FOREIGN PATENT DOCUMENTS

EP 3319758 1/2017
WO WO 2003-008151 1/2003
WO WO 2007-005452 1/2007
WO WO 2011-068714 6/2011
WO WO 2012-112305 8/2012
WO WO 2012-112322 8/2012
WO WO 2014-131937 9/2014
WO WO 2014-176108 10/2014
WO WO 2014-206967 12/2014
WO WO 2015-100018 7/2015
WO WO 2015-100020 7/2015
WO WO 2015-100220 7/2015
WO WO 2016-028683 2/2016
WO WO 2016-044158 3/2016
WO WO 2016-064726 4/2016
WO WO 2016-089675 6/2016
WO WO 2016-205133 12/2016
WO WO 2016-205267 12/2016
WO WO 2017-007703 1/2017
WO WO 2017-007714 1/2017
WO WO 2017-083249 5/2017
WO WO 2017-083255 5/2017
WO WO 2018-080765 5/2018
WO WO 2018-118596 6/2018
WO WO 2018-118690 6/2018
WO WO 2018-118695 6/2018
WO WO 2018-134732 7/2018
WO WO 2018-207145 11/2018
WO WO 2019-215571 11/2019
WO WO 2020-128716 6/2020
WO WO 2020-128717 6/2020
WO WO 2020-128719 6/2020
WO WO 2020-128720 6/2020
WO WO 2020-128752 6/2020
WO WO 2020-128833 6/2020
WO WO 2020-128838 6/2020
WO WO 2020-128842 6/2020
WO WO 2020-128844 6/2020
WO WO 2020-128845 6/2020
WO WO 2020-128852 6/2020
WO WO 2020-128854 6/2020

(56) References Cited

FOREIGN PATENT DOCUMENTS

| | | |
|---|---|---|
| WO | WO 2020-128857 | 6/2020 |
| WO | WO 2020-128858 | 6/2020 |

OTHER PUBLICATIONS

International Search Report for PCT International Application No. PCT/IB2019/060615, dated Feb. 26, 2020, 5 pages.
International Search Report for PCT International Application No. PCT/IB2019/060624, dated Mar. 11, 2020, 4 pages.
International Search Report for PCT International Application No. PCT/IB2019/060627, dated Jul. 2, 2020, 8 pages.
International Search Report for PCT International Application No. PCT/IB2019/060779, dated Mar. 10, 2020, 5 pages.
International Search Report for PCT International Application No. PCT/IB2019/060924, dated Apr. 29, 2020, 4 pages.
International Search Report for PCT International Application No. PCT/IB2019/060929, dated Mar. 23, 2020, 4 pages.
International Search Report for PCT International Application No. PCT/IB2019/060934, dated Mar. 18, 2020, 5 pages.
International Search Report for PCT International Application No. PCT/IB2019/060936, dated Mar. 30, 2020, 5 pages.
International Search Report for PCT International Application No. PCT/IB2019/060938, dated Apr. 28, 2020, 4 pages.
International Search Report for PCT International Application No. PCT/IB2019/060947, dated Mar. 30, 2020, 5 pages.
International Search Report for PCT International Application No. PCT/IB2019/060949, dated Jun. 5, 2020, 4 pages.
International Search Report for PCT International Application No. PCT/IB2019/060950, dated Mar. 30, 2020, 5 pages.
International Search Report for PCT International Application No. PCT/IB2019/060953, dated Apr. 2, 2020, 4 pages.
International Search Report for PCT International Application No. PCT/IB2019/060954, dated Apr. 24, 2020, 5 pages.

* cited by examiner

TOOLING SPLICE ACCOMMODATION FOR ABRASIVE ARTICLE PRODUCTION

CROSS REFERENCE TO RELATED APPLICATIONS

This application is a national stage filing under 35 U.S.C. 371 of PCT/IB2019/060949, filed Dec. 17, 2019, which claims the benefit of U.S. Provisional Application No. 62/780,998, filed Dec. 18, 2018, the disclosures of which are incorporated by reference in their entireties herein.

BACKGROUND

The present invention relates generally to abrasive articles, and in particular to preventing gaps in abrasive particles created by gaps in cavities of a production tool.

Abrasive articles can be produced using a production tool that includes cavities configured to deliver shaped abrasive particles to a resin coated backing. The cavities can be positioned on the tooling to create a desired pattern of shaped particles on the abrasive article. In some examples, the production tool can be configured to form an endless belt. In making the endless belt, two ends of a production tool can be spliced together, destroying or otherwise interrupting the cavities of the production tool. This interruption in cavities can result in a gap in the shaped abrasive particles on the abrasive article.

SUMMARY OF THE DISCLOSURE

In one aspect of the present disclosure, a method of producing an abrasive article includes moving a production tool along a first web path, the production tool having a first end and a second end spliced together forming a spliced area. The method also includes providing first shaped abrasive particles to a plurality of cavities formed in a dispensing surface of the production tool, and moving a resin coated backing along a second web path. The method also includes dispensing the first shaped abrasive particles from the plurality of cavities to the resin coated backing, and dispensing second shaped abrasive particles to the resin coated backing into gaps in the first shaped abrasive particles caused by an absence of the plurality of cavities in the spliced area.

In another aspect of the present disclosure, a method of producing an abrasive article includes splicing a first end of a production tool to a second end of the production tool. The production tool includes a plurality of first cavities. The method also includes forming a plurality of second cavities in the spliced area, providing shaped abrasive particles to the plurality of first cavities and the plurality of second cavities, and dispensing the shaped abrasive particles from the plurality of first cavities and the plurality of second cavities to a resin coated backing.

In another aspect of the present disclosure, a system for producing an abrasive article includes a production tool and a resin coated backing. The production tool includes a first end and a second end spliced together to form a spliced area. The production tool also includes a dispensing surface that includes a plurality of cavities formed between the first end and the second end and configured to receive and hold first shaped abrasive particles. The resin coated backing is configured to receive the first shaped abrasive particles from the dispensing surface of the production tool and is configured to receive second shaped abrasive particles to fill gaps in the first shaped abrasive particles caused by an absence of the plurality of cavities in the spliced area.

BRIEF DESCRIPTION OF THE FIGURES

The drawings illustrate generally, by way of example, but not by way of limitation, various embodiments discussed in the present document.

DETAILED DESCRIPTION

Figure 1:
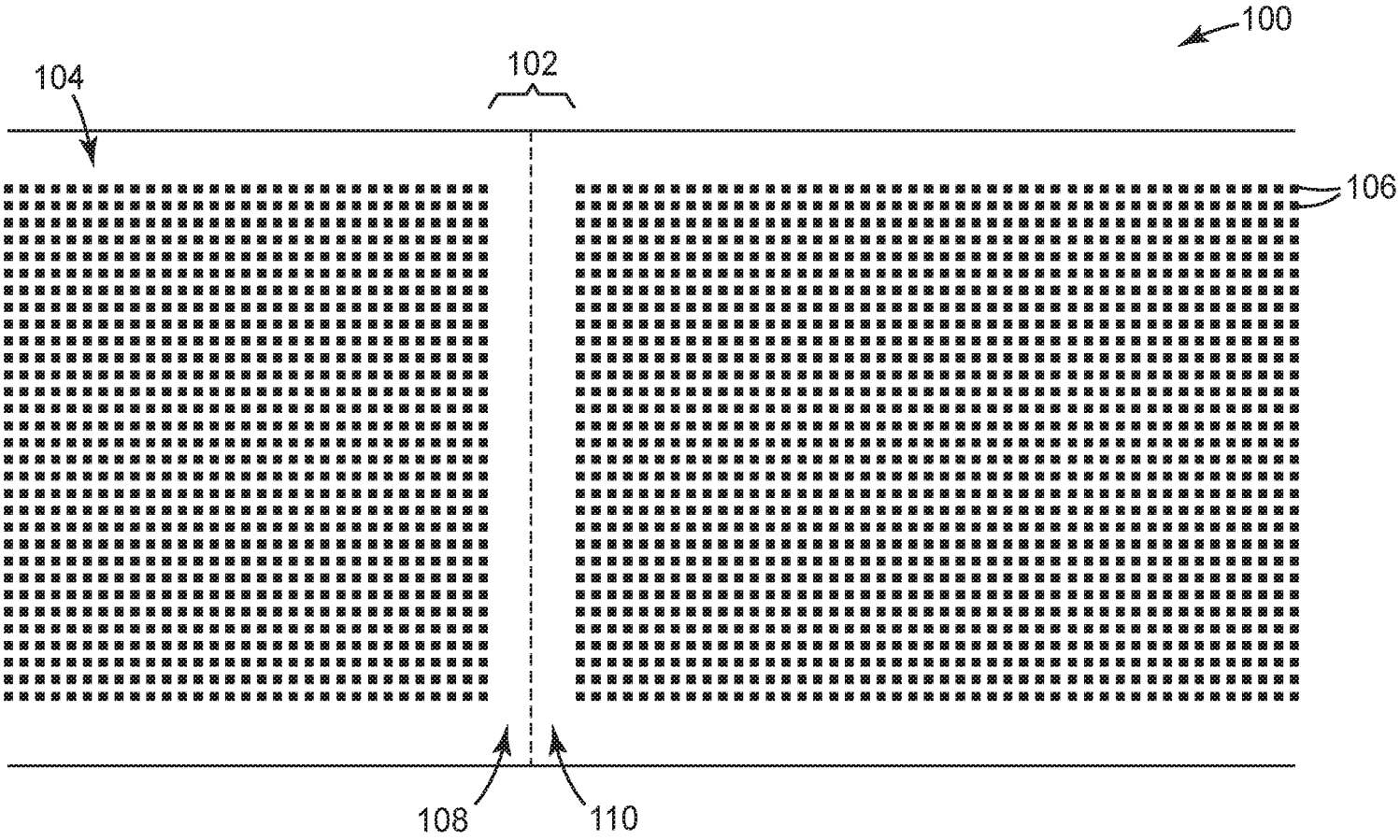
FIG. 1 is a schematic diagram of a production tool that includes a spliced region.

Reference will now be made in detail to certain embodiments of the disclosed subject matter, examples of which are illustrated in part in the accompanying drawings. While the disclosed subject matter will be described in conjunction with the enumerated claims, it will be understood that the exemplified subject matter is not intended to limit the claims to the disclosed subject matter.

Throughout this document, values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "about 0.1% to about 5%" or "about 0.1% to 5%" should be interpreted to include not just about 0.1% to about 5%, but also the individual values (e.g., 1%, 2%, 3%, and 4%) and the sub-ranges (e.g., 0.1% to 0.5%, 1.1% to 2.2%, 3.3% to 4.4%) within the indicated range. The statement "about X to Y" has the same meaning as "about X to about Y," unless indicated otherwise. Likewise, the statement "about X, Y, or about Z" has the same meaning as "about X, about Y, or about Z," unless indicated otherwise.

In this document, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed herein, and not otherwise defined, is for the purpose of description only and not of limitation. Any use of section headings is intended to aid reading of the document and is not to be interpreted as limiting; information that is relevant to a section heading may occur within or outside of that particular section.

In the methods described herein, the acts can be carried out in any order without departing from the principles of the disclosure, except when a temporal or operational sequence is explicitly recited. Furthermore, specified acts can be carried out concurrently unless explicit claim language recites that they be carried out separately. For example, a claimed act of doing X and a claimed act of doing Y can be conducted simultaneously within a single operation, and the resulting process will fall within the literal scope of the claimed process.

The term "about" as used herein can allow for a degree of variability in a value or range, for example, within 10%, within 5%, or within 1% of a stated value or of a stated limit of a range, and includes the exact stated value or range.

The term "substantially" as used herein refers to a majority of, or mostly, as in at least about 50%, 60%, 70%, 80%, 90%, 95%, 96%, 97%, 98%, 99%, 99.5%, 99.9%, 99.99%, or at least about 99.999% or more, or 100%.

As used herein "shaped abrasive particle" means an abrasive particle having a predetermined or non-random shape. One process to make a shaped abrasive particle such as a shaped ceramic abrasive particle includes shaping the precursor ceramic abrasive particle in a mold having a predetermined shape to make ceramic shaped abrasive particles. Ceramic shaped abrasive particles, formed in a mold, are one species in the genus of shaped ceramic abrasive particles. Other processes to make other species of shaped ceramic abrasive particles include extruding the precursor ceramic abrasive particle through an orifice having a predetermined shape, printing the precursor ceramic abrasive particle though an opening in a printing screen having a predetermined shape, or embossing the precursor ceramic abrasive particle into a predetermined shape or pattern. In other examples, the shaped ceramic abrasive particles can be cut from a sheet into individual particles. Examples of suitable cutting methods include mechanical cutting, laser cutting, or water jet cutting. Non-limiting examples of shaped ceramic abrasive particles include shaped abrasive particles, such as triangular plates, or elongated ceramic rods/filaments. Shaped ceramic abrasive particles are generally homogenous or substantially uniform and maintain their sintered shape without the use of a binder such as an organic or inorganic binder that bonds smaller abrasive particles into an agglomerated structure and excludes abrasive particles obtained by a crushing or comminution process that produces abrasive particles of random size and shape. In many embodiments, the shaped ceramic abrasive particles comprise a homogeneous structure of sintered alpha alumina or consist essentially of sintered alpha alumina.

FIG. 1 is a schematic view of a production tool 100 that includes a spliced area 102. The production tool 100 can include a carrier member that has a dispensing surface 104. The dispensing surface 104 includes cavities 106 that extend into the production tool 100 from the dispensing surface 104. The production tool 100 can include other optional components including, but not limited to, a compressible resilient layer secured to a back surface of the production tool 100. Cavities 106 can be disposed in an array, as illustrated, or in any other desirable pattern.

The openings of the cavities 106 at the dispensing surface 104 can be rectangular or any other desired shape. The length, width, and depth of the cavities 106 can be determined at least in part by the shape and size of the abrasive particles which the cavities 106 will receive. For example, if the abrasive particles are shaped as equilateral trigonal plates, then the lengths of individual cavities can be from 1.1-1.5 times the maximum length of a side of the abrasive particles, the widths of individual cavities can be from 1.1-2.5 times the thickness of the abrasive particles, and the respective depths of the cavities 106 can be 1.0 to 1.5 times the width of the abrasive particles if the abrasive particles are to be contained within the cavities 106.

Suitable carrier members for the production tool 100 can be rigid or flexible. In one example, the carrier member of the production tool 100 is sufficiently flexible to permit use of normal web handling devices such as rollers. In some examples, the carrier member includes metal and/or organic polymer. Such organic polymers can be moldable, have low cost, and are reasonably durable when used in the abrasive particle deposition process of the present disclosure. Examples of organic polymers, which can be thermosetting and/or thermoplastic, that can be suitable for fabricating the carrier member include: polypropylene, polyethylene, vulcanized rubber, polycarbonates, polyamides, acrylonitrile-butadiene-styrene plastic (ABS), polyethylene terephthalate (PET), polybutylene terephthalate (PET), polyimides, polyetheretherketone (PEEK), polyetherketone (PEK), and polyoxymethylene plastic (POM, acetal), poly(ether sulfone), poly(methyl methacrylate), polyurethanes, polyvinyl chloride, and combinations thereof.

Figure 2:
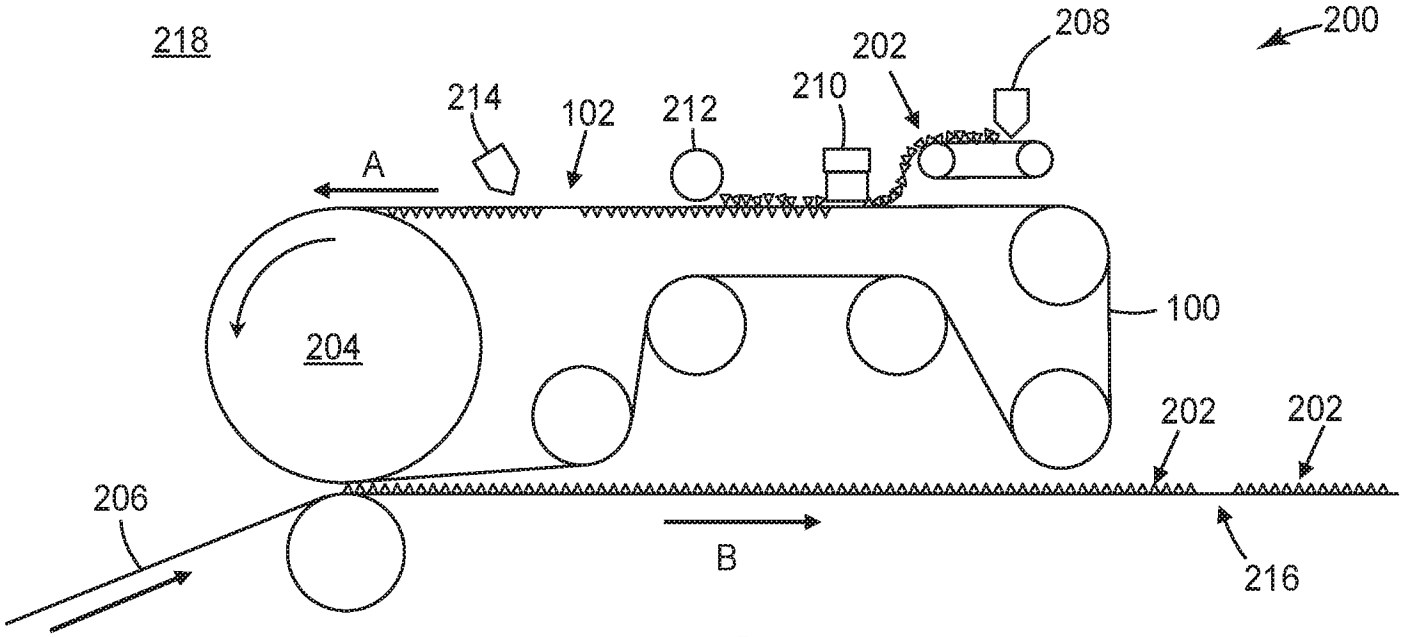
FIG. 2 is a schematic diagram of an apparatus for creating an abrasive article using a production tool.

The production tool 100 can be in the form of, for example, an endless belt (as seen in FIG. 2), a sheet, a continuous sheet or web, a coating roll, a sleeve mounted on a coating roll, or die. If the production tool is in the form of a belt, a first end 108 of the production tool 100 can be spliced together with a second end 110 to form the endless belt. The process of splicing the ends 108 and 110 together can destroy or otherwise interrupt any cavities 106 in the spliced region 102. The two ends 108 and 110 can be spliced together using thermal welding, sewing, gluing, or any other method of connecting the two ends to form an endless belt.

FIG. 2 is a schematic diagram of a system 200 for making a coated abrasive article according to the present disclosure. The system 200 includes abrasive particles 202 removably disposed within the cavities 106 of the production tool 100 having a first path A guiding the production tool 100 through the coated abrasive article maker system 200 such that it wraps a portion of an outer circumference of an abrasive particle transfer roll 204. A resin coated backing 206 is moved along a second path B. Prior to the transfer roll 204, the system 200 can further include, for example, an unwind, a make coat delivery system, and a make coat applicator. These components can unwind a backing, deliver a make coat resin via the make coat delivery system to the make coat applicator and apply the make coat resin to a first major surface of the backing. Thereafter the resin coated backing 206 is positioned for application of the abrasive particles 202 to the resin layer of the resin coated backing 206. The make coat applicator can be, for example, a coater, a roll coater, a spray system, or a rod coater. Alternatively, a pre-coated coated backing can be positioned for application of the abrasive particles 202 to the first major surface of the resin coated backing 206.

The path B for the resin coated backing 206 guides the resin coated backing through the system 200 such that it wraps a portion of, or passes closely to, the outer circumference of the abrasive particle transfer roll 204 with the resin layer positioned facing the dispensing surface of the production tool 100 that is positioned between the resin coated backing 206 and the outer circumference of the abrasive particle transfer roll 204. The backing can be a cloth, paper, film, mesh, nonwoven, scrim, or other web substrate.

An abrasive particle feeder 210 supplies at least some abrasive particles 202 to the production tool 100. In some examples, the abrasive particle feeder 210 supplies an excess of abrasive particles 202 such that there are more abrasive particles 202 present per unit length of the production tool 200 in the machine direction than cavities 106 present. Supplying an excess of abrasive particles 202 helps ensure all cavities 106 within the production tool 100 are eventually filled with an abrasive particle 202. The abrasive particle feeder 208 can be a same width as the production tool 100 and supply abrasive particles across the entire width of the production tool 100. The abrasive particle feeder 208 can be, for example, a vibratory feeder, a hopper, a chute, a silo, a drop coater, or a screw feeder.

In an example, one or more filling assist members 210, 212, and 214 are provided after the abrasive particle feeder 208 to move the abrasive particles 202 around on the surface of the production tool 100 and to help orientate or slide the abrasive particles 202 into the cavities 106. The filling assist members 210, 212, and 214 can be, for example, one or more of a doctor blade, a felt wiper, a brush having a plurality of bristles, a vibration system, a blower or air knife, a vacuum box, or combinations thereof. The filling assist members 210, 212, and 214 move, translate, suck, or agitate the abrasive particles 202 on the dispensing surface of the production tool 100 to place more abrasive particles 202 into the cavities 106. In an example, the filling assist member 210 is a brush, and the bristles may cover a section of the dispensing surface from 2-4 inches (5.0-10.2 cm) in length in the machine direction preferably across all or most all of the width of the dispensing surface, and lightly rest on or just above the dispensing surface and be of a moderate flexibility.

In an example, the filling assist members 212 and 214 can be a roller brush and an air knife used to further fill the cavities 106 of the production tool 100 and remove excess abrasive particles 202 from the surface of the production tool 100 once most or all of the cavities 106 have been filled by an abrasive particle 202. While illustrated as a brush, a roller brush, and an air knife, other methods for filling the cavities and removing excess particles can be employed including, for example, an air wand, air shower, a coanda effect nozzle, a blower, a scraper, a wiper, or a doctor blade. In other examples, a vacuum source such as vacuum box or vacuum roll can also be located along a portion of the path A after the abrasive particle feeder 208 and can be used to hold the abrasive particles 202 in the cavities 106 of the production tool 100.

An abrasive particle transfer roll 204 is provided and the production tooling 200 can wrap at least a portion of the circumference of the transfer roll 204. In some embodiments, the production tool 100 wraps between 30 to 180 degrees, or between 90 to 180 degrees of the outer circumference of the abrasive particle transfer roll 204. The resin coated backing 206 can also wrap a portion of the circumference of the transfer roll 204 or pass closely by the transfer roll 204 such that the abrasive particles 202 in the cavities of the production tool 100 are transferred from the cavities 106 to the resin coated backing 206 as both traverse around or near the abrasive particle transfer roll 204 with the dispensing surface of the production tool 100 facing and generally aligned with the resin layer of the resin coated backing 206.

Various methods can be used to transfer the abrasive particles 204 from the cavities 106 of the production tool 100 to the resin coated backing 206. In an example, the particles 202 can be transferred using a gravity assist where the production tool 100 is inverted for a portion of its machine direction travel and the abrasive particles 202 fall out of the cavities 106 under the force of gravity and onto the resin coated backing 206. In another example, the particles 202 can be transferred using a pushing assist where each cavity 106 in the production tool 100 has two open ends such that the abrasive particle can reside in the cavity 106 with a portion of the abrasive particle 202 extending past a back surface of the production tool 100. In another example, the particles 202 can be transferred using a vibration assist where the abrasive particle transfer roll 204 or production tool 100 is vibrated by a suitable source such as an ultrasonic device to shake the abrasive particles 202 out of the cavities 106 and onto the resin coated backing 206. In another example, the particles 202 can be transferred using a pressure assist.

The abrasive particle transfer roll 204 can precisely transfer and position each abrasive particle 202 onto the resin coated backing 206 substantially reproducing the pattern of abrasive particles 202 and their specific orientation as arranged in the production tool 100. However, due to the interruption in cavities 106 caused by the spliced region 202 in the production tool 100, gaps 216 in the pattern of the abrasive particles 202 can form on the resin coated backing 206. It is desirable to either prevent the gaps 216 from forming, or to fill the gaps 216 with particles 202 to avoid breaks in the pattern of the abrasive particles 202 in the final product.

The system 200 can also include a control and visual system 218. In an example, the control and visual system 218 can include one or more processors, one or more memory devices, and one or more sensors. The control and visual system 218 can include one or more cameras or other optical sensors or instruments capable of detecting the gaps 216 and/or other conditions of the system 200. The control and visual system 218 can also include one or more processors, such as a microprocessor, a controller, a digital signal processor (DSP), an application specific integrated circuit (ASIC), a field-programmable gate array (FPGA), or equivalent discrete or integrated logic circuitry. The one or more processors can be utilized to provide control for the system 200. In one example, the processors can use input from one or more sensors to automatically detect and provide control to handle the gaps 216 in the abrasive particles 202.

Figure 3A:
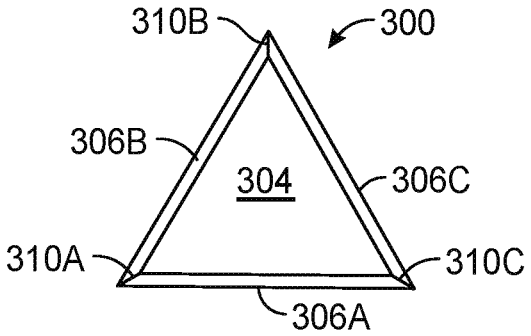
FIGS. 3A and 3B are schematic diagrams of shaped abrasive particles having a planar trigonal shape, in accordance with various embodiments.
Figure 3B:
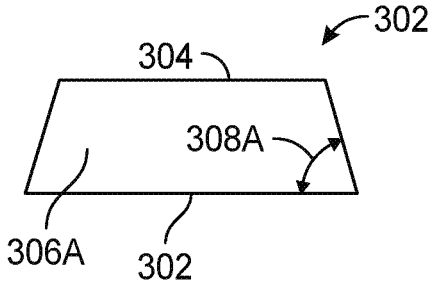

FIGS. 3A and 3B show an example of a shaped abrasive particle 300, as an equilateral triangle conforming to a truncated pyramid. The shaped abrasive particle 300 can be used as any of the abrasive particles 202 shown in FIG. 2, for example. As shown in FIGS. 3A and 3B the shaped abrasive particle 300 includes a truncated regular triangular pyramid bounded by a triangular base 302, a triangular top 304, and plurality of sloping sides 306A, 306B, 306C, connecting a triangular base 302 (shown as equilateral although scalene, obtuse, isosceles, and right triangles are possible) and the triangular top 304. Slope angle 308A is the dihedral angle formed by the intersection of the side 306A with the triangular base 302. Similarly, slope angles 308B and 308C (both not shown) correspond to the dihedral angles formed by the respective intersections of sides 306B and 306C with the triangular base 302. In the case of the shaped abrasive particle 300, all of the slope angles have equal value. In some embodiments, the side edges 310A, 310B, and 310C have an average radius of curvature in a range of from about 0.5 μm to about 80 μm, about 10 μm to about 60 μm, or less than, equal to, or greater than about 0.5 μm, 5, 10, 15, 20, 25, 30, 35, 40, 45, 50, 55, 60, 65, 70, 75, or about 80 μm.

In the embodiment shown in FIGS. 3A and 3B, the sides 306A, 306B, and 306C have equal dimensions and form dihedral angles with the triangular base 302 of about 82 degrees (corresponding to a slope angle of 82 degrees). However, it will be recognized that other dihedral angles (including 90 degrees) may also be used. For example, the dihedral angle between the base and each of the sides may independently range from 45 to 90 degrees (for example, from 70 to 90 degrees, or from 75 to 85 degrees). Edges connecting the sides 306, base 302, and the top 304 can have any suitable length. For example, a length of the edges may be in a range of from about 0.5 μm to about 2000 μm, about 150 μm to about 200 μm, or less than, equal to, or greater than about 0.5 μm, 50, 100, 150, 200, 250, 300, 350, 400, 450, 500, 550, 600, 650, 700, 750, 800, 850, 900, 950, 1000, 1050, 1100, 1150, 1200, 1250, 1300, 1350, 1400, 1450, 1500, 1550, 1600, 1650, 1700, 1750, 1800, 1850, 1900, 1950, or about 2000 μm.

Figure 4A:
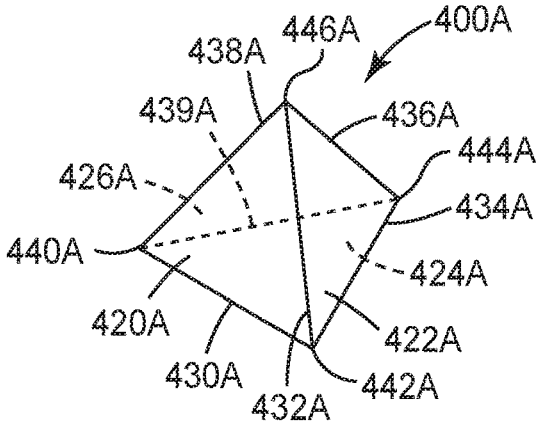
FIGS. 4A-4E are schematic diagrams of shaped abrasive particles having a tetrahedral shape, in accordance with various embodiments.

FIGS. 4A-4E are perspective views of the shaped abrasive particles 400 shaped as tetrahedral abrasive particles. The shaped abrasive particles 400A-400E can be used as any of the shaped abrasive particles 202 shown in FIG. 2, for example. As shown in FIGS. 4A-4E, the shaped abrasive particles 400 are shaped as regular tetrahedrons. As shown in FIG. 4A, the shaped abrasive particle 400A has four faces (420A, 422A, 424A, and 426A) joined by six edges (430A, 432A, 434A, 436A, 438A, and 439A) terminating at four vertices (440A, 442A, 444A, and 446A). Each of the faces contacts the other three of the faces at the edges. While a regular tetrahedron (e.g., having six equal edges and four faces) is depicted in FIG. 4A, it will be recognized that other shapes are also permissible. For example, the tetrahedral abrasive particles 400 can be shaped as irregular tetrahedrons (e.g., having edges of differing lengths).

Figure 4B:
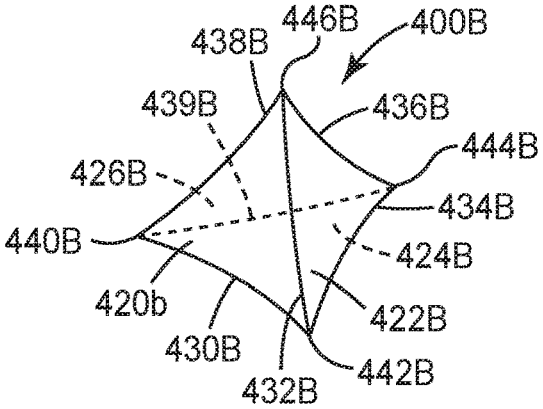

Referring now to FIG. 4B, the shaped abrasive particle 400B has four faces (420B, 422B, 424B, and 426B) joined by six edges (430B, 432B, 434B, 436B, 438B, and 439B) terminating at four vertices (440B, 442B, 444B, and 446B). Each of the faces is concave and contacts the other three of the faces at respective common edges. While a particle with tetrahedral symmetry (e.g., four rotational axes of threefold symmetry and six reflective planes of symmetry) is depicted in FIG. 4B, it will be recognized that other shapes are also permissible. For example, shaped abrasive particles 400B can have one, two, or three concave faces with the remainder being planar.

Figure 4C:
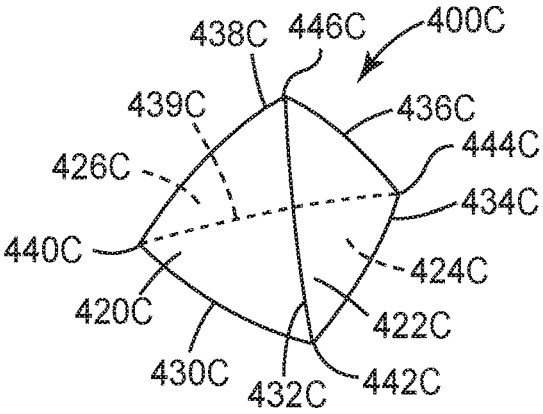

Referring now to FIG. 4C, the shaped abrasive particle 400C has four faces (420C, 422C, 424C, and 426C) joined by six edges (430C, 432C, 434C, 436C, 438C, and 439C) terminating at four vertices (440C, 442C, 444C, and 446C). Each of the faces is convex and contacts the other three of the faces at respective common edges. While a particle with tetrahedral symmetry is depicted in FIG. 4C, it will be recognized that other shapes are also permissible. For example, shaped abrasive particles 400C can have one, two, or three convex faces with the remainder being planar or concave.

Figure 4D:
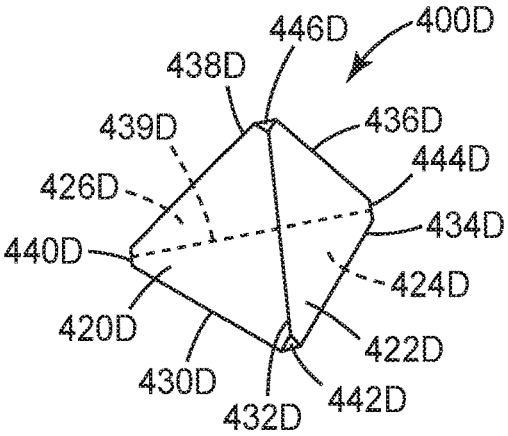

Referring now to FIG. 4D, the shaped abrasive particle 400D has four faces (420D, 422D, 424D, and 426D) joined by six edges (430D, 432D, 434D, 436D, 438D, and 439D) terminating at four vertices (440D, 442D, 444D, and 446D). While a particle with tetrahedral symmetry is depicted in FIG. 4D, it will be recognized that other shapes are also permissible. For example, shaped abrasive particles 400D can have one, two, or three convex faces with the remainder being planar.

Figure 4E:
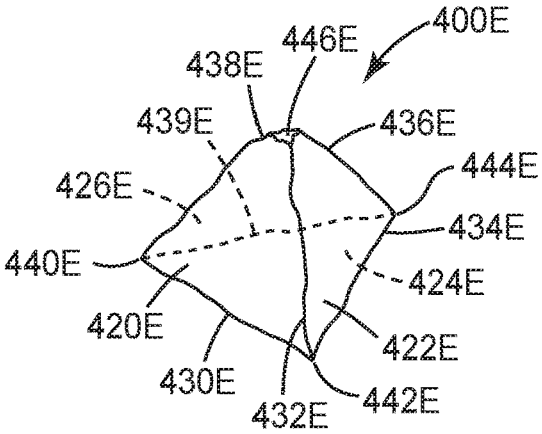

Deviations from the depictions in FIGS. 4A-4D can be present. An example of such a shaped abrasive particle 400 is depicted in FIG. 4E, showing shaped a abrasive particle 400E, which has four faces (420E, 422E, 424E, and 426E) joined by six edges (430E, 432E, 434E, 436E, 438E, and 439E) terminating at four vertices (440E, 442E, 444E, and 446E). Each of the faces contacts the other three of the faces at respective common edges. Each of the faces, edges, and vertices has an irregular shape.

In any of shaped abrasive particles 400A-400E, the edges can have the same length or different lengths. The length of any of the edges can be any suitable length. As an example, the length of the edges can be in a range of from about 0.5 μm to about 2000 μm, about 150 μm to about 200 μm, or less than, equal to, or greater than about 0.5 μm, 50, 100, 150, 200, 250, 300, 350, 400, 450, 500, 550, 600, 650, 700, 750, 800, 850, 900, 950, 1000, 1050, 1100, 1150, 1200, 1250, 1300, 1350, 1400, 1450, 1500, 1550, 1600, 1650, 1700, 1750, 1800, 1850, 1900, 1950, or about 2000 μm. The shaped abrasive particles 400A-400E can be the same size or different sizes.

Any of shaped abrasive particles 300 or 400 can include any number of shape features. The shape features can help to improve the cutting performance of any of shaped abrasive particles 300 or 400. Examples of suitable shape features include an opening, a concave surface, a convex surface, a groove, a ridge, a fractured surface, a low roundness factor, or a perimeter comprising one or more corner points having a sharp tip. Individual shaped abrasive particles can include any one or more of these features.

In addition to the materials already described, at least one magnetic material may be included within or coated to shaped abrasive particle 300 or 400. Examples of magnetic materials include iron; cobalt; nickel; various alloys of nickel and iron marketed as Permalloy in various grades; various alloys of iron, nickel and cobalt marketed as Fernico, Kovar, FerNiCo I, or FerNiCo II; various alloys of iron, aluminum, nickel, cobalt, and sometimes also copper and/or titanium marketed as Alnico in various grades; alloys of iron, silicon, and aluminum (about 85:9:6 by weight) marketed as Sendust alloy; Heusler alloys (e.g., $Cu_2MnSn$); manganese bismuthide (also known as Bismanol); rare earth magnetizable materials such as gadolinium, dysprosium, holmium, europium oxide, alloys of neodymium, iron and boron (e.g., $Nd_2Fe_{14}B$), and alloys of samarium and cobalt (e.g., $SmCo_5$); MnSb; $MnOFe_2O_3$; $Y_3Fe_5O_{12}$; $CrO_2$; MnAs; ferrites such as ferrite, magnetite; zinc ferrite; nickel ferrite; cobalt ferrite, magnesium ferrite, barium ferrite, and strontium ferrite; yttrium iron garnet; and combinations of the foregoing. In some embodiments, the magnetizable material is an alloy containing 8 to 12 weight percent aluminum, 15 to 26 wt % nickel, 5 to 24 wt % cobalt, up to 6 wt % copper, up to 1% titanium, wherein the balance of material to add up to 100 wt % is iron. In some other embodiments, a magnetizable coating can be deposited on an abrasive particle 300 or 400 using a vapor deposition technique such as, for example, physical vapor deposition (PVD) including magnetron sputtering.

Including these magnetizable materials can allow shaped abrasive particle 300 or 400 to be responsive a magnetic field. Any of the shaped abrasive particles 300 or 400 can include the same material or include different materials.

Figure 5A:
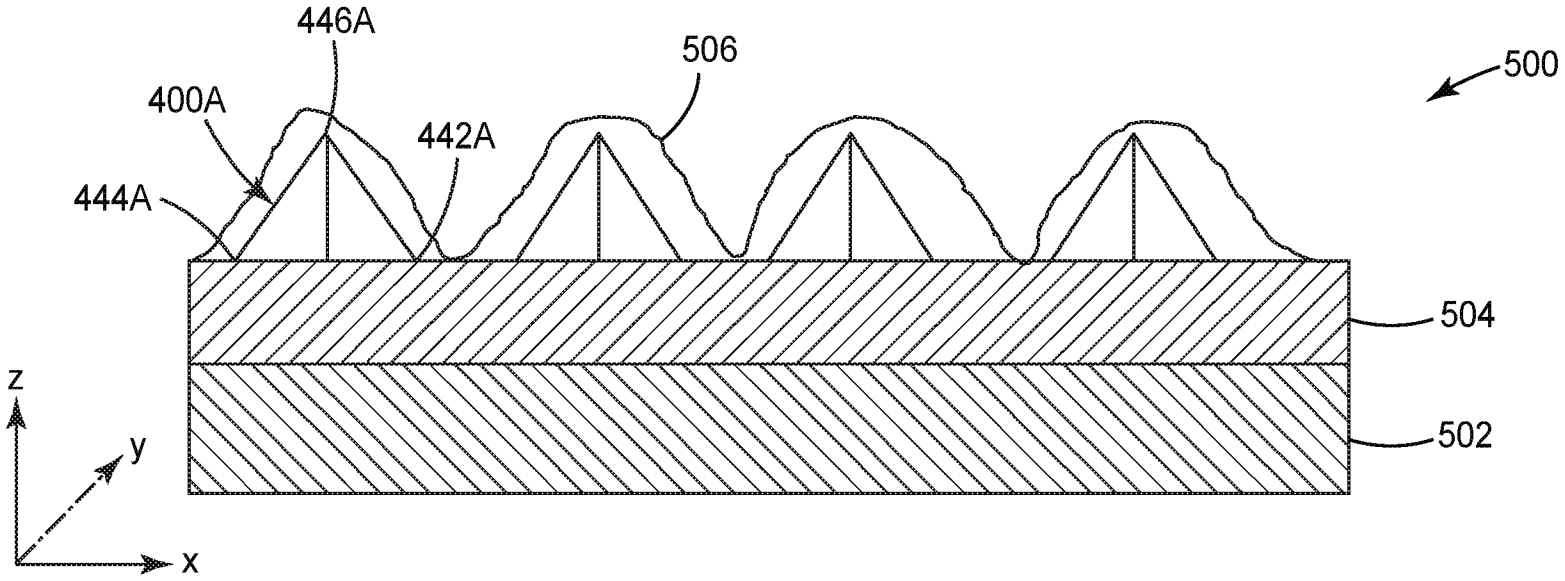
FIGS. 5A and 5B are sectional views of coated abrasive articles, in accordance with various embodiments.

FIG. 5A is a sectional view of a coated abrasive article 500. The coated abrasive article 500 can be produced using the system illustrated in FIG. 2, for example. The coated abrasive article 500 includes a backing 502 defining a surface along an x-y direction. The backing 502 has a first layer of binder, hereinafter referred to as make coat 504, applied over a first surface of the backing 502. Attached or partially embedded in the make coat 504 are a plurality of shaped abrasive particles 400A. Although shaped abrasive particles 400A are shown, any other shaped abrasive particle described herein can be included in coated abrasive article 500. An optional second layer of binder, hereinafter referred to as a size coat 506, is dispersed over the shaped abrasive particles 400A. As shown, a major portion of the shaped abrasive particles 400A have at least one of three vertices (440, 442, and 444) oriented in substantially the same direction. Thus, the shaped abrasive particles 400A are oriented according to a non-random distribution, although in other embodiments any of shaped abrasive particles 400A can be randomly oriented on the backing 502. In some embodiments, control of a particle's orientation can increase the cut of the abrasive article.

The backing 502 can be flexible or rigid. Examples of suitable materials for forming a flexible backing include a polymeric film, a metal foil, a woven fabric, a knitted fabric, paper, vulcanized fiber, a staple fiber, a continuous fiber, a nonwoven, a foam, a screen, a laminate, and combinations thereof. Backing 502 can be shaped to allow the coated abrasive article 500 to be in the form of sheets, discs, belts, pads, or rolls. In some embodiments, the backing 502 can be sufficiently flexible to allow the coated abrasive article 500 to be formed into a loop to make an abrasive belt that can be run on suitable grinding equipment.

The make coat 504 secures the shaped abrasive particles 400A to the backing 502, and the size coat 506 can help to reinforce the shaped abrasive particles 400A. The make coat 504 and/or the size coat 506 can include a resinous adhesive. The resinous adhesive can include one or more resins chosen from a phenolic resin, an epoxy resin, a urea-formaldehyde resin, an acrylate resin, an aminoplast resin, a melamine resin, an acrylated epoxy resin, a urethane resin, a polyester resin, a dying oil, and mixtures thereof.

Figure 5B:
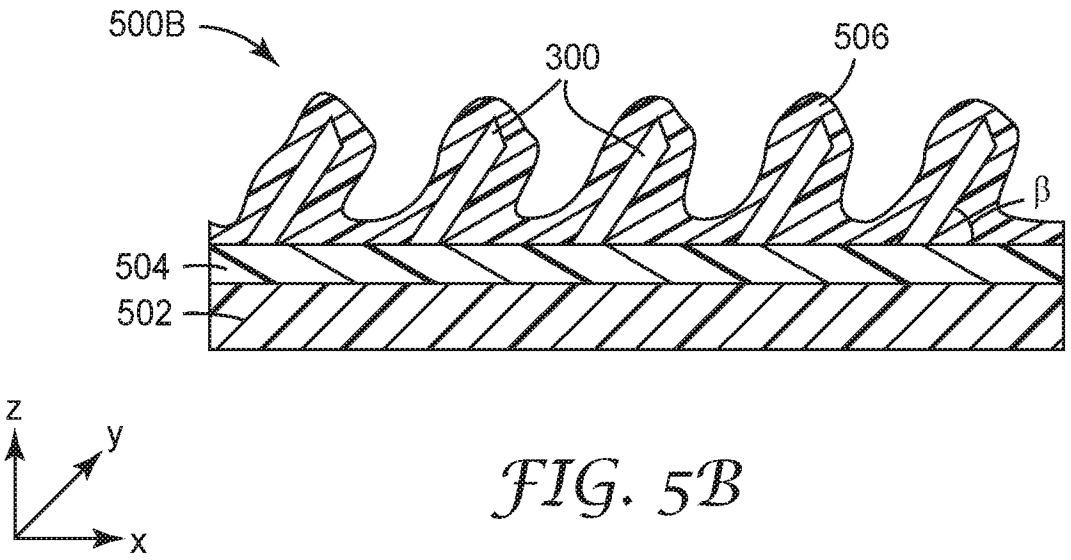

FIG. 5B shows an example of a coated abrasive article 500B, which includes the shaped abrasive particles 300 instead of shaped abrasive particles 400. As shown, the shaped abrasive particles 300 are attached to backing 502 by make coat 504 with the size coat 506 applied to further attach or adhere the shaped abrasive particles 300 to the backing 502. As shown in FIG. 5B, the majority of the shaped abrasive particles 300 are tipped or leaning to one side. This results in the majority of shaped abrasive particles 300 having an orientation angle β less than 90 degrees relative to the backing 502.

The abrasive article 500 can also include conventional (e.g., crushed) abrasive particles. Examples of useful abrasive particles include fused aluminum oxide-based materials such as aluminum oxide, ceramic aluminum oxide (which can include one or more metal oxide modifiers and/or seeding or nucleating agents), and heat-treated aluminum oxide, silicon carbide, co-fused alumina-zirconia, diamond, ceria, titanium diboride, cubic boron nitride, boron carbide, garnet, flint, emery, sol-gel derived abrasive particles, and mixtures thereof.

The conventional abrasive particles can, for example, have an average diameter ranging from about 10 μm to about 2000 μm, about 20 μm to about 1300 μm, about 50 μm to about 1000 μm, less than, equal to, or greater than about 10 μm, 20, 30, 40, 50, 100, 150, 200, 250, 300, 350, 400, 450, 500, 550, 600, 650, 700, 750, 800, 850, 900, 950, 1000, 1050, 1100, 1150, 1200, 1250, 1300, 1350, 1400, 1450, 1500, 1550, 1650, 1700, 1750, 1800, 1850, 1900, 1950, or 2000 μm. For example, the conventional abrasive particles can have an abrasives industry-specified nominal grade. Such abrasives industry-accepted grading standards include those known as the American National Standards Institute, Inc. (ANSI) standards, Federation of European Producers of Abrasive Products (FEPA) standards, and Japanese Industrial Standard (HS) standards. Exemplary ANSI grade designations (e.g., specified nominal grades) include: ANSI 12 (1842 μm), ANSI 16 (1320 μm), ANSI 20 (905 μm), ANSI 24 (728 μm), ANSI 36 (530 μm), ANSI 40 (420 μm), ANSI 50 (351 μm), ANSI 60 (264 μm), ANSI 80 (195 μm), ANSI 100 (141 μm), ANSI 120 (116 μm), ANSI 150 (93 μm), ANSI 180 (78 μm), ANSI 220 (66 μm), ANSI 240 (53 μm), ANSI 280 (44 μm), ANSI 320 (46 μm), ANSI 360 (30 μm), ANSI 400 (24 μm), and ANSI 600 (16 μm). Exemplary FEPA grade designations include P12 (1746 μm), P16 (1320 μm), P20 (984 μm), P24 (728 μm), P30 (630 μm), P36 (530 μm), P40 (420 μm), P50 (326 μm), P60 (264 μm), P80 (195 μm), P100 (156 μm), P120 (127 μm), P120 (127 μm), P150 (97 μm), P180 (78 μm), P220 (66 μm), P240 (60 μm), P280 (53 μm), P320 (46 μm), P360 (41 μm), P400 (36 μm), P500 (30 μm), P600 (26 μm), and P800 (22 μm). An approximate average particles size of reach grade is listed in parenthesis following each grade designation.

The shaped abrasive particles 300 or 400 or crushed abrasive particles can include any suitable material or mixture of materials. For example, the shaped abrasive particles 300 can include a material chosen from an alpha-alumina, a fused aluminum oxide, a heat-treated aluminum oxide, a ceramic aluminum oxide, a sintered aluminum oxide, a silicon carbide, a titanium diboride, a boron carbide, a tungsten carbide, a titanium carbide, a diamond, a cubic boron nitride, a garnet, a fused alumina-zirconia, a sol-gel derived abrasive particle, a cerium oxide, a zirconium oxide, a titanium oxide, and combinations thereof. In some embodiments, the shaped abrasive particles 300 or 400 and crushed abrasive particles can include the same materials. In further embodiments, the shaped abrasive particles 300 or 400 and crushed abrasive particles can include different materials.

Filler particles can also be included in abrasive articles 500A or 500B. Examples of useful fillers include metal carbonates (such as calcium carbonate, calcium magnesium carbonate, sodium carbonate, magnesium carbonate), silica (such as quartz, glass beads, glass bubbles and glass fibers), silicates (such as talc, clays, montmorillonite, feldspar, mica, calcium silicate, calcium metasilicate, sodium aluminosilicate, sodium silicate), metal sulfates (such as calcium sulfate, barium sulfate, sodium sulfate, aluminum sodium sulfate, aluminum sulfate), gypsum, vermiculite, sugar, wood flour, a hydrated aluminum compound, carbon black, metal oxides (such as calcium oxide, aluminum oxide, tin oxide, titanium dioxide), metal sulfites (such as calcium sulfite), thermoplastic particles (such as polycarbonate, polyetherimide, polyester, polyethylene, poly(vinylchloride), polysulfone, polystyrene, acrylonitrile-butadiene-styrene block copolymer, polypropylene, acetal polymers, polyurethanes, nylon particles) and thermosetting particles (such as phenolic bubbles, phenolic beads, polyurethane foam particles and the like). The filler may also be a salt such as a halide salt. Examples of halide salts include sodium chloride, potassium cryolite, sodium cryolite, ammonium cryolite, potassium tetrafluoroborate, sodium tetrafluoroborate, silicon fluorides, potassium chloride, magnesium chloride. Examples of metal fillers include, tin, lead, bismuth, cobalt, antimony, cadmium, iron and titanium. Other miscellaneous fillers include sulfur, organic sulfur compounds, graphite, lithium stearate and metallic sulfides. In some embodiments, individual shaped abrasive particles 100 or individual crushed abrasive particles can be at least partially coated with an amorphous, ceramic, or organic coating. Examples of suitable components of the coatings include, a silane, glass, iron oxide, aluminum oxide, or combinations thereof. Coatings such as these can aid in processability and bonding of the particles to a resin of a binder.

Figure 6:
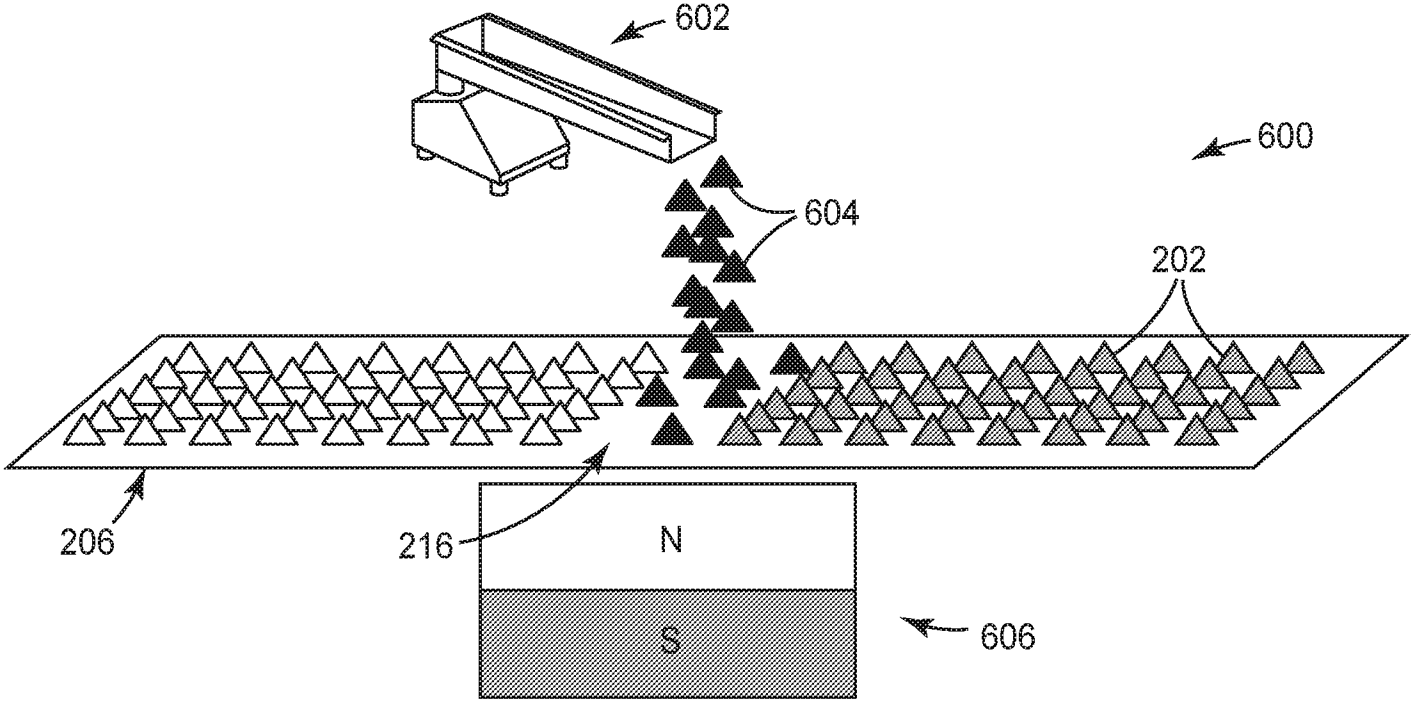
FIG. 6 is a diagram of a system for filling gaps in abrasive particles caused by a spliced region of a production tool.

FIG. 6 illustrates a system 600 for filling the gaps 216 in the pattern of the abrasive particles 202 on the resin coated backing 206. The system 600 includes an apparatus 602 configured to deliver shaped abrasive particles 604 to gaps 216. In an example, a downward sloping dispensing surface of the apparatus 600 may be inclined at any suitable angle, provided that the magnetizable particles 604 can travel down the surface and be dispensed onto the web. Suitable angles may be in a range of from 15 to 60 degrees, although other angles may also be used. In some instances, it may be desirable to vibrate the downward sloping dispensing surface to facilitate particle movement. The downward sloping dispensing surface may be constructed of any dimensionally stable material, that may be non-magnetizable.

One or more magnets 606 can be placed near the resin coated backing 206 to provide a magnetic field to aid in aligning the particles 604. While illustrated as a generic magnet 606, the applied magnetic fields can be provided by one or more permanent magnets and/or electromagnet(s), or a combination of magnets and ferromagnetic members, for example. The applied magnetic field can be static or variable (e.g., oscillating). As discussed above, the particles 604 can include at least one magnetic material and therefore, the magnet(s) 606 can be used to provide a magnetic field that aligns the particles 604 in a desired manner.

In one example, the magnetic field can be formed such that the magnetizable particles 604 (having a structure corresponding to shaped abrasive particles 202, for example) are dropped through a portion of the magnetic field onto the resin coated backing 206 and have a desired z-direction rotational angle. The magnetizable particles 604 can be predominantly deposited into the gaps 216 after travelling down a dispensing surface of the apparatus 602. In one example, while travelling down the dispensing surface, the longest edge of the magnetizable particle 604 can align with the magnetic field. Throughout the method, at least until transfer of the magnetizable abrasive particles 604 to the gap 216, the magnetizable particles 604 are continuously oriented by the applied magnetic field with their longest axis being aligned substantially parallel (or antiparallel) with the magnetic field lines. Once transferred, the applied magnetic field may continue to exert an orienting influence on the magnetizable abrasive particles 604, although this is not requirement.

In general, applied magnetic fields used in practice of the present disclosure have a field strength in the region of the magnetizable particles being affected (e.g., attracted and/or oriented) of at least about 10 gauss (1 mT), at least about 100 gauss (10 mT), or at least about 1000 gauss (0.1 T), although this is not a requirement.

The particles 604 can be delivered manually or automatically. For example, the control and visual system 218 can be used to detect a gap 216 in the particles 202 on the resin coated backing 206. Upon detection of a gap 216, the control and visual system 218 can provide control for the apparatus 602 to release the particles 604 for application to the detected gap 216. Any method of automatic control of the apparatus 602 can be utilized. For example, a mechanical gate can be used by apparatus 602 to hold the particles 604 in place. Upon detection of a gap 216, the control and visual system 218 can provide a control signal to the apparatus 602 to open the gate and allow the particles 604 to travel down the dispensing surface and onto the resin coated backing in the detected gap 216.

In one example, abrasive particles 604 can continuously be provided to the resin coated backing 206, but at varying quantities. For example, when there is no gap 216 present, a first quantity of particles 604 can be provided to the resin coated backing, and when a gap 216 is detected, a second quantity greater than the first quantity can be provide to the gap 216. This can help to mask differences in the pattern of particles on the resin coated backing between the particles 202 and the particles 604 such that the eye is not immediately drawn to the particles 604 in the filled gap 216.

Figure 7:
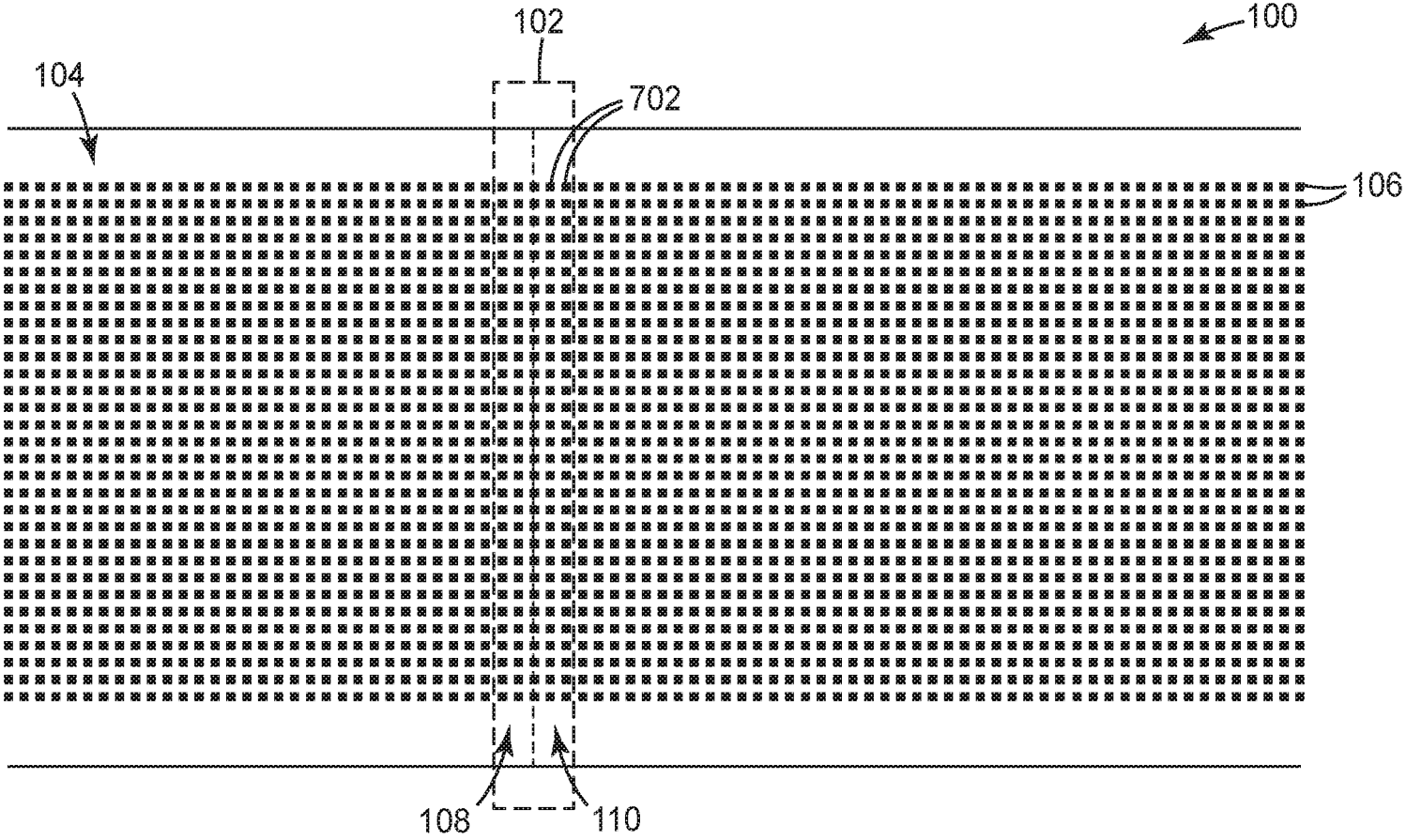
FIG. 7 is a diagram of a tooling that includes cavities for carrying shaped abrasive particles within a spliced region of the tooling.

FIG. 7 is a schematic perspective view of a production tool 700 that includes a spliced area 102. The production tool 700 can be substantially similar to the production tool 100 illustrated in FIG. 1. The production tool 700 includes cavities 702 created within the spliced area 102 of the production tool 700. The cavities 702 can be of similar size, shape, and pattern to the cavities 106 in the dispensing surface 104 of the production tool 700 or can be of any other size and shape.

To form a continuous belt, the production tool 700 can have a first end 108 spliced together with a second end 110. The splice can be performed using a thermal weld, sewing, gluing, or any other method of splicing the two ends together. During a thermal weld, for example, any cavities 106 present in the spliced area 102 can be destroyed, resulting in no cavities in the spliced area 102 (as illustrated in FIG. 1). Following the destruction of the cavities 106 in the spliced area 102, a process can be used to create new cavities 702 in the spliced area 102. The cavities can be of similar size, shape, and pattern to the cavities 106, or can be any other shape including, for example, small holes through the production tool 100 such that a vacuum source can be used to hold the particles 202 for application to the resin coated backing 206.

In one example, when performing a thermal weld, an upper heat seal jaw can include an embossing pattern that defines the cavities 702. Thus, the cavities 702 can be formed in the splice area 102 during the thermal weld process. In another example, the cavities 702 can be formed in the spliced area 102 following completion of the thermal weld process. For example, following the weld process, another heat process can be used to create the cavities 702 in the spliced area 102. While described as thermal welding, any method of splicing the first end 108 to the second end 110 can be used. In addition to using heat to form the cavities 702, any other method, including ultrasonic methods, for example, can be used to form the cavities 702.

As seen in FIG. 2, the splice area 102 creates a gap in cavities on the dispensing surface of the production tool, which leads to a gap 216 in particles delivered to the resin coated backing 206. By forming the cavities 702 in the splice area 102, the gap in cavities on the production tool can be eliminated, thereby eliminating the gaps 216 in particles 202 on the resin coated backing 206.

Figure 8:
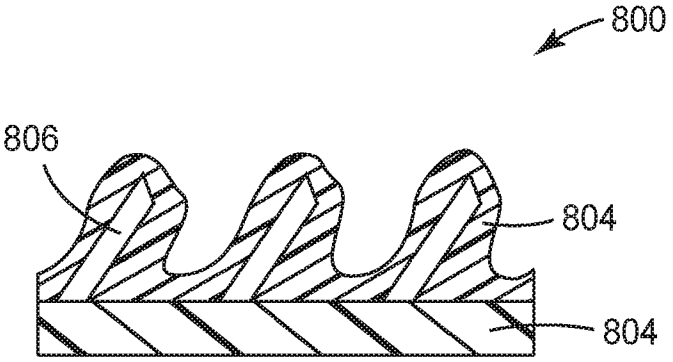
FIG. 8 is a backless abrasive usable for filling gaps in shaped abrasive particles caused by a spliced region of a production tool.

FIG. 8 is a sectional view of a backless abrasive article 800 that includes a make coat 802, a size coat 804, and particles 806. The particles 806 can be any of the shaped abrasive particles described herein. The make coat 802 and/or the size coat 804 can include a resinous adhesive or any other adhesive. The resinous adhesive can include one or more resins chosen from a phenolic resin, an epoxy resin, a urea-formaldehyde resin, an acrylate resin, an aminoplast resin, a melamine resin, an acrylated epoxy resin, a urethane resin, a polyester resin, a dying oil, and mixtures thereof. The article 800 does not include a backing so as to facilitate application to the gaps 216 in the particles 202 caused by the spliced area 102 of the production tool 100.

The backless abrasive article 800 can be produced using the system 200 or any other method. In one example, the backless abrasive article is produced directly without a backing. For example, a two-sided adhesive can be used, and the particles 604 can be applied directly to one side of the two-sided adhesive. In another example, an article, such as those shown in FIGS. 5A and 5B, can be produced by the system 200 and then the backing 502 can be removed. In one example, once the backing 502 is removed, an adhesive can be applied to facilitate application to the resin coated backing 206.

The backless abrasive article 800 can be applied to the gaps 216 to provide abrasive particles 604 within the gaps 216. This process can be performed manually or automatically. The control and visual system 218, for example, can include a system or apparatus, such as a robotics system, controllable to apply the backless abrasive article 800 each time a gap 216 is detected in the resin coated backing 206. In one example, a continuous sheet of backless abrasive can be formed, and each time a gap 216 is detected, the continuous sheet can be pulled across the gap 216, cut to size, and applied to fill the gap 216 either manually or automatically.

Additional Embodiments

The following exemplary embodiments are provided, the numbering of which is not to be construed as designating levels of importance:

In a first embodiment, the present disclosure provides a method of producing an abrasive article includes moving a production tool along a first web path, the production tool having a first end and a second end spliced together forming a spliced area. The method also includes providing first shaped abrasive particles to a plurality of cavities formed in a dispensing surface of the production tool, and moving a resin coated backing along a second web path. The method also includes dispensing the first shaped abrasive particles from the plurality of cavities to the resin coated backing, and dispensing second shaped abrasive particles to the resin coated backing into gaps in the first shaped abrasive particles caused by an absence of the plurality of cavities in the spliced area.

In a second embodiment, the present disclosure provides a method according to the first embodiment, wherein the second shaped abrasive particles comprise at least one magnetic material, and wherein dispensing the second shaped abrasive particles to the resin coated backing into the gaps in the first shaped abrasive particles comprises dispensing the second shaped abrasive particles to the resin coated backing into the gaps formed in the first shaped abrasive particles on the resin coated backing; and aligning the second shaped abrasive particles within the gaps using a magnetic field.

In a third embodiment, the present disclosure provides a method according to the second embodiment, wherein dispensing the second shaped abrasive particles to the resin coating backing in the gaps formed in the first shaped abrasive particles comprises automatically dispensing the second shaped abrasive particles in the gaps, at a position along the second web path, and following dispensing of the first shaped abrasive particles from the plurality of cavities to the resin coated backing.

In a fourth embodiment, the present disclosure provides a method according to the third embodiment, wherein automatically dispensing the second shaped abrasive particles in the gaps comprises automatically detecting the gaps in the first shaped abrasive particles at the position along the second web path; and automatically dispensing the second shaped abrasive particles in response to detecting the gaps in the first shaped abrasive particles.

In a fifth embodiment, the present disclosure provides a method according to the first embodiment, wherein dispensing the second shaped abrasive particles to the resin coated backing to prevent gaps in the first shaped abrasive particles caused by the spliced area comprises producing a filler abrasive article with the second shaped abrasive particles; and applying the filler abrasive article to the gaps in the first shaped abrasive particles caused by the spliced area.

In a sixth embodiment, the present disclosure provides a method according to the fifth embodiment, wherein producing a filler abrasive article comprises producing a backless abrasive article with the second shaped abrasive particles.

In a seventh embodiment, the present disclosure provides a method according to the, a method of producing an abrasive article includes splicing a first end of a production tool to a second end of the production tool. The production tool includes a plurality of first cavities. The method also includes forming a plurality of second cavities in the spliced area, providing shaped abrasive particles to the plurality of first cavities and the plurality of second cavities, and dispensing the shaped abrasive particles from the plurality of first cavities and the plurality of second cavities to a resin coated backing.

In an eighth embodiment, the present disclosure provides a method according to the seventh embodiment, a wherein the plurality of second cavities are formed in the spliced area during the splicing of the first end of the production tool to the second end of the production tool.

In a ninth embodiment, the present disclosure provides a method according to the seventh embodiment, wherein the plurality of second cavities are formed in the spliced area after the splicing of the first end of the production tool to the second end of the production tool.

In a tenth embodiment, the present disclosure provides a system for producing an abrasive article includes a production tool and a resin coated backing. The production tool includes a first end and a second end spliced together to form a spliced area. The production tool also includes a dispensing surface that includes a plurality of cavities formed between the first end and the second end and configured to receive and hold first shaped abrasive particles. The resin coated backing is configured to receive the first shaped abrasive particles from the dispensing surface of the production tool and is configured to receive second shaped abrasive particles to fill gaps in the first shaped abrasive particles caused by an absence of the plurality of cavities in the spliced area.

In an eleventh embodiment, the present disclosure provides a system according to the tenth embodiment, further comprising a dispensing apparatus positioned to dispense the second shaped abrasive particles into the gaps in the first shaped abrasive particles, wherein the second shaped abrasive particles comprise at least one magnetic material.

In a twelfth embodiment, the present disclosure provides a system according to the eleventh embodiment, further comprising a magnetic field positioned to align the dispensed second shaped abrasive particles within the gaps in the first shaped abrasive particles.

In a thirteenth embodiment, the present disclosure provides a system according to the eleventh or twelfth embodiments, wherein the production tool is moved along a first web path and the resin coated backing is moved along a second web path to receive the first shaped abrasive particles from the dispensing surface, and wherein the dispensing apparatus is positioned to dispense the second shaped abrasive particles along the second path downweb from receipt of the first shaped abrasive particles from the production tool.

In a fourteenth embodiment, the present disclosure provides a system according to the tenth embodiment, further comprising a filler abrasive article comprising an adhesive and the second shaped abrasive particles, and wherein the filler abrasive article is applied to the resin coated backing to fill the gaps in the first shaped abrasive particles.

In a fifteenth embodiment, the present disclosure provides a system according to the fourteenth embodiment, wherein the filler abrasive article is a backless abrasive article that includes the second shaped abrasive particles.

What is claimed is:

1. A method of producing an abrasive article, the method comprising:

moving a production tool along a first web path, the production tool having a first end and a second end spliced together forming a spliced area;

providing first shaped abrasive particles to a plurality of cavities formed in a dispensing surface of the production tool;

moving a resin coated backing along a second web path;

dispensing the first shaped abrasive particles from the plurality of cavities to the resin coated backing;

dispensing second shaped abrasive particles to the resin coated backing into gaps in the first shaped abrasive particles caused by an absence of the plurality of cavities in the spliced area.

2. The method of claim 1, wherein the second shaped abrasive particles comprise at least one magnetic material, and wherein dispensing the second shaped abrasive particles to the resin coated backing into the gaps in the first shaped abrasive particles comprises:

dispensing the second shaped abrasive particles to the resin coated backing into the gaps formed in the first shaped abrasive particles on the resin coated backing; and aligning the second shaped abrasive particles within the gaps using a magnetic field.

3. The method of claim 2, wherein dispensing the second shaped abrasive particles to the resin coating backing in the gaps formed in the first shaped abrasive particles comprises automatically dispensing the second shaped abrasive particles in the gaps, at a position along the second web path, and following dispensing of the first shaped abrasive particles from the plurality of cavities to the resin coated backing.

4. The method of claim 3, wherein automatically dispensing the second shaped abrasive particles in the gaps comprises:

automatically detecting the gaps in the first shaped abrasive particles at the position along the second web path; and automatically dispensing the second shaped abrasive particles in response to detecting the gaps in the first shaped abrasive particles.

5. The method of claim 1, wherein dispensing the second shaped abrasive particles to the resin coated backing to prevent gaps in the first shaped abrasive particles caused by the spliced area comprises:

producing a filler abrasive article with the second shaped abrasive particles; and applying the filler abrasive article to the gaps in the first shaped abrasive particles caused by the spliced area.

6. The method of claim 5, wherein producing a filler abrasive article comprises producing a backless abrasive article with the second shaped abrasive particles.

7. A method of producing an abrasive article, the method comprising:

splicing a first end of a production tool to a second end of the production tool, wherein the production tool includes a plurality of first cavities;

forming a plurality of second cavities in the spliced area;

providing shaped abrasive particles to the plurality of first cavities and the plurality of second cavities; and dispensing the shaped abrasive particles from the plurality of first cavities and the plurality of second cavities to a resin coated backing.

8. The method of claim 7, wherein the plurality of second cavities are formed in the spliced area during the splicing of the first end of the production tool to the second end of the production tool.

9. The method of claim 7, wherein the plurality of second cavities are formed in the spliced area after the splicing of the first end of the production tool to the second end of the production tool.

10. A system for producing an abrasive article, the system comprising:

a production tool having a first end and a second end spliced together to form a spliced area, the production tool comprising:

a dispensing surface that includes a plurality of cavities formed between the first end and the second end and configured to receive and hold first shaped abrasive particles;

a resin coated backing configured to receive the first shaped abrasive particles from the dispensing surface of the production tool and configured to receive second shaped abrasive particles to fill gaps in the first shaped abrasive particles caused by an absence of the plurality of cavities in the spliced area.

11. The system of claim 10, further comprising a dispensing apparatus positioned to dispense the second shaped abrasive particles into the gaps in the first shaped abrasive particles, wherein the second shaped abrasive particles comprise at least one magnetic material.

12. The system of claim 11, further comprising a magnetic field positioned to align the dispensed second shaped abrasive particles within the gaps in the first shaped abrasive particles.

13. The system of claim 11, wherein the production tool is moved along a first web path and the resin coated backing is moved along a second web path to receive the first shaped abrasive particles from the dispensing surface, and wherein the dispensing apparatus is positioned to dispense the second shaped abrasive particles along the second path downweb from receipt of the first shaped abrasive particles from the production tool.

14. The system of claim 10, further comprising a filler abrasive article comprising an adhesive and the second shaped abrasive particles, and wherein the filler abrasive article is applied to the resin coated backing to fill the gaps in the first shaped abrasive particles.

15. The system of claim 14, wherein the filler abrasive article is a backless abrasive article that includes the second shaped abrasive particles.

16. The system of claim 12, wherein the production tool is moved along a first web path and the resin coated backing is moved along a second web path to receive the first shaped abrasive particles from the dispensing surface, and wherein the dispensing apparatus is positioned to dispense the second shaped abrasive particles along the second path downweb from receipt of the first shaped abrasive particles from the production tool.

* * * * *